US006966389B1

(12) United States Patent
Riggs

(10) Patent No.: US 6,966,389 B1
(45) Date of Patent: Nov. 22, 2005

(54) COMBINATION STAPLE GUN AND CAP FEEDING DEVICE

(75) Inventor: Gregory Scott Riggs, Goldsboro, NC (US)

(73) Assignee: SDGI Holdings, Inc., Wilmington, DE (US)

( * ) Notice: Subject to any disclaimer, the term of this patent is extended or adjusted under 35 U.S.C. 154(b) by 64 days.

(21) Appl. No.: 10/721,618

(22) Filed: Nov. 25, 2003

(51) Int. Cl.[7] ..... E21B 7/00
(52) U.S. Cl. ..... 173/1; 227/138
(58) Field of Search ..... 227/28, 39, 100, 227/106, 129, 147; 173/1

(56) References Cited

U.S. PATENT DOCUMENTS 539,065 A * 5/1895 Lombard ..... 227/116
3,595,460 A * 7/1971 Pitkin ..... 227/32
4,339,065 A * 7/1982 Haytayan ..... 227/8
5,184,752 A * 2/1993 Zylka et al. ..... 221/1
5,328,075 A 7/1994 Marks
5,634,583 A * 6/1997 McGuinness et al. ..... 227/120
5,791,546 A * 8/1998 McGuinness et al. ..... 227/120
5,947,362 A * 9/1999 Omli ..... 227/120
6,302,310 B1 10/2001 Lamb
6,543,666 B1 4/2003 Huang
6,598,776 B2 7/2003 Adachi et al.
6,659,326 B2 * 12/2003 Huang ..... 227/18

* cited by examiner

*Primary Examiner*—Louis K. Huynh
*Assistant Examiner*—Paul Durand
(74) *Attorney, Agent, or Firm*—Coats & Bennett, P.L.L.C.

(57) ABSTRACT

A combination manual staple gun and a cap feeding device comprises a staple gun having a cap feeding device attached thereto. Interconnected between the staple gun and the cap feeding device is an actuating linkage. The actuating linkage is connected to a movable member of the staple gun and is driven in response to the actuation of the staple gun or in response to the staple gun being pressed against a surface for the purpose of shooting a staple into the surface. More particularly, the cap feeder device includes a container for containing a stack of caps and a cap feeder or feeding mechanism for engaging one cap at a time and directing the cap towards a cap ejection area associated with a staple gun in response to the connecting or actuating linkage being actuated.

25 Claims, 5 Drawing Sheets

COMBINATION STAPLE GUN AND CAP FEEDING DEVICE

FIELD OF THE INVENTION

The present invention relates to staple guns and more particularly to a staple gun having a cap feeding device for automatically feeding one cap at a time to the staple gun such that when the staple gun is actuated or fired a staple is directed through the cap.

BACKGROUND OF THE INVENTION

It is known to use nail guns to attach roofing material such as tarpaper to the roof of a structure. It is also known to use small plastic caps to engage and hold tarpaper on the roof. Many such caps include nails prepositioned in the caps. A roofer will typically use a hammer and manually drive the prepositioned nail into the roof, securing the cap over the tarpaper in the process. This is a time consuming, laborious and expensive process. It is not easy for a roofer to stand on an inclined roof, and manually hold a supply of such caps and at the same time secure them into the roof structure.

It is known to provide cap feeding devices for employment with nail guns. These cap feeding devices automatically place a cap under the nail gun and thereafter the nail gun drives a nail downwardly through the cap into the underlying structure. However, there are many drawbacks to such conventional cap feeding devices. In many cases they are large, bulky, hard to handle, and in the end, are expensive. In many cases the combined nail gun and cap feeding device is so heavy that the weight alone makes it difficult for the average operator to handle and efficiently use.

One example of a conventional combination staple gun and cap feeding device is disclosed in U.S. Pat. No. 6,302,310 and entitled "Staple and Nail Gun Assembly, Cap Fitting Device for Staple or Nail Gun, and Cap Assembly." This assembly includes a container for receiving the caps and the container is fixedly connected to a rear end of the handle of the staple gun. A base is connected between the lower end of the container and the nose portion of the staple gun. The caps are filled in a passageway formed in the base and moved by a pneumatic device so that the caps are fed into a cap holding chamber located beneath the nose portion of the staple gun, one cap at a time. In this case, the position of the container makes the whole assembly bulky and difficult to handle.

There has been and continues to be a need for a simple, lightweight and easy to handle combination staple gun and cap feeding device.

SUMMARY OF THE INVENTION

The present invention entails a combination staple gun and cap feeding device that comprises an actuating mechanism or linkage that actuates the cap feeding device in response to the staple gun being actuated. In one embodiment, the device comprises a manual staple gun that is provided with an actuating mechanism or linkage for actuating the cap feeding in response to the staple gun being pressed against a surface which results in the staple gun shooting or directing a staple therefrom into the underlying surface.

In one particular embodiment of the present invention, the combination staple gun and cap feeding device comprises a staple gun for ejecting one staple at a time into a surface. A cap feeding device is attached to the staple gun for dispensing one cap at a time into the path of the staple being ejected from the staple gun. The cap feeding device includes a cap container for containing a stack of caps. A shuttle mechanism disposed adjacent the cap container includes a feeder for moving back and forth between a first and second position. A guide is provided and extends between the cap feeding device and the staple gun for directing caps from the cap feeding device to a position adjacent the staple gun such that staples being ejected from the staple gun are directed through the caps, one at a time. A mechanical linkage or mechanism is connected between the staple gun and the cap feeding device for causing one cap at a time to be positioned in the path of respective staples being ejected by the staple gun. This mechanical linkage or mechanism is actuated or moved in response to the staple gun being actuated and is operative to actuate the shuttle mechanism and the feeder.

Further, the present invention entails a method of feeding caps from a cap feeding device to a staple gun wherein the cap feeding device is attached to or forms a part of the staple gun. The method includes engaging a surface with the staple gun and pressing the staple gun against the surface and causing one portion of the staple gun to move with respect to another portion. In response to one portion of the staple gun moving with respect to the other portion, the method entails driving a cap feeder associated with the cap feeding device by moving a linkage that is interconnected between the staple gun and the cap feeding device. In one particular embodiment, the cap feeding device is fixed with respect to one portion of the staple gun while the actuating linkage is connected to the other portion of the staple gun such that when there is relative movement between the two portions of the staple gun, the actuating linkage is effectively driven, causing the cap feeding device to dispense one cap at a time from the cap feeding device.

Other objects and advantages of the present invention will become apparent and obvious from a study of the following description and the accompanying drawings which are merely illustrative of such invention.

DESCRIPTION OF EXEMPLARY EMBODIMENT

With further reference to the drawings, the combination staple gun and cap feeding device of the present invention is shown therein and indicated generally by the numeral 10. Basically this device comprises two main assemblies, a staple gun and a cap feeding device indicated generally by the numeral 30. The staple gun portion of the device comprises a manually actuated staple gun that includes two movable portions, a main body indicated generally by the numeral 12 and a movable member indicated generally by the numeral 14. Details of the staple gun itself are not dealt with herein because such is not per se material to the present invention and further, manual staple guns and even automatic or semi-automatic staple guns are well know in the art. For example, note the disclosures found in U.S. Pat. Nos. 6,302,310; 6,543,666; 6,598,776; and 5,328,075. The disclosures of these patents are expressly incorporated herein by reference.

Figure 1:
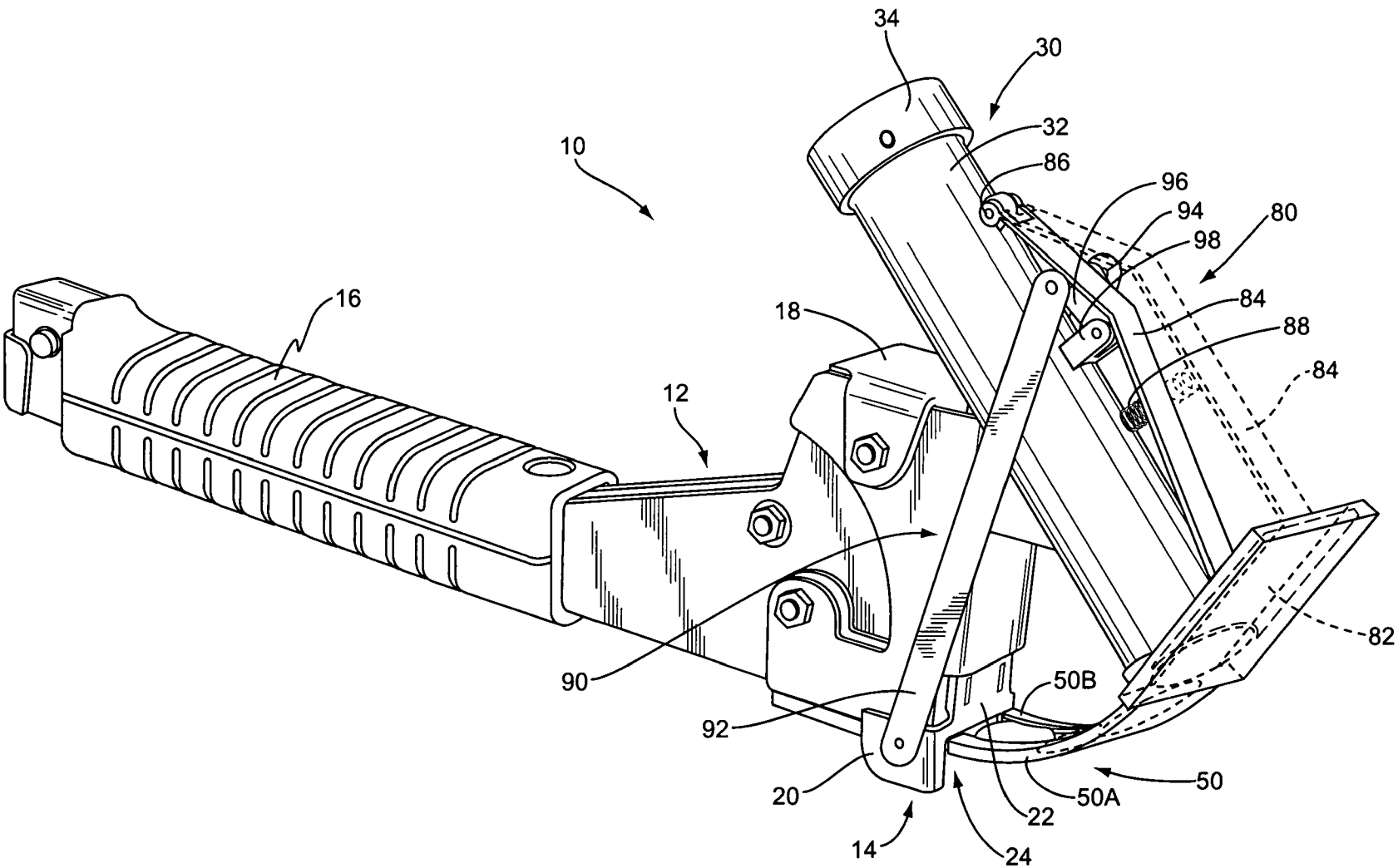
FIG. 1 is a perspective view showing the combination staple gun and cap feeding device of the present invention.
Figure 2:
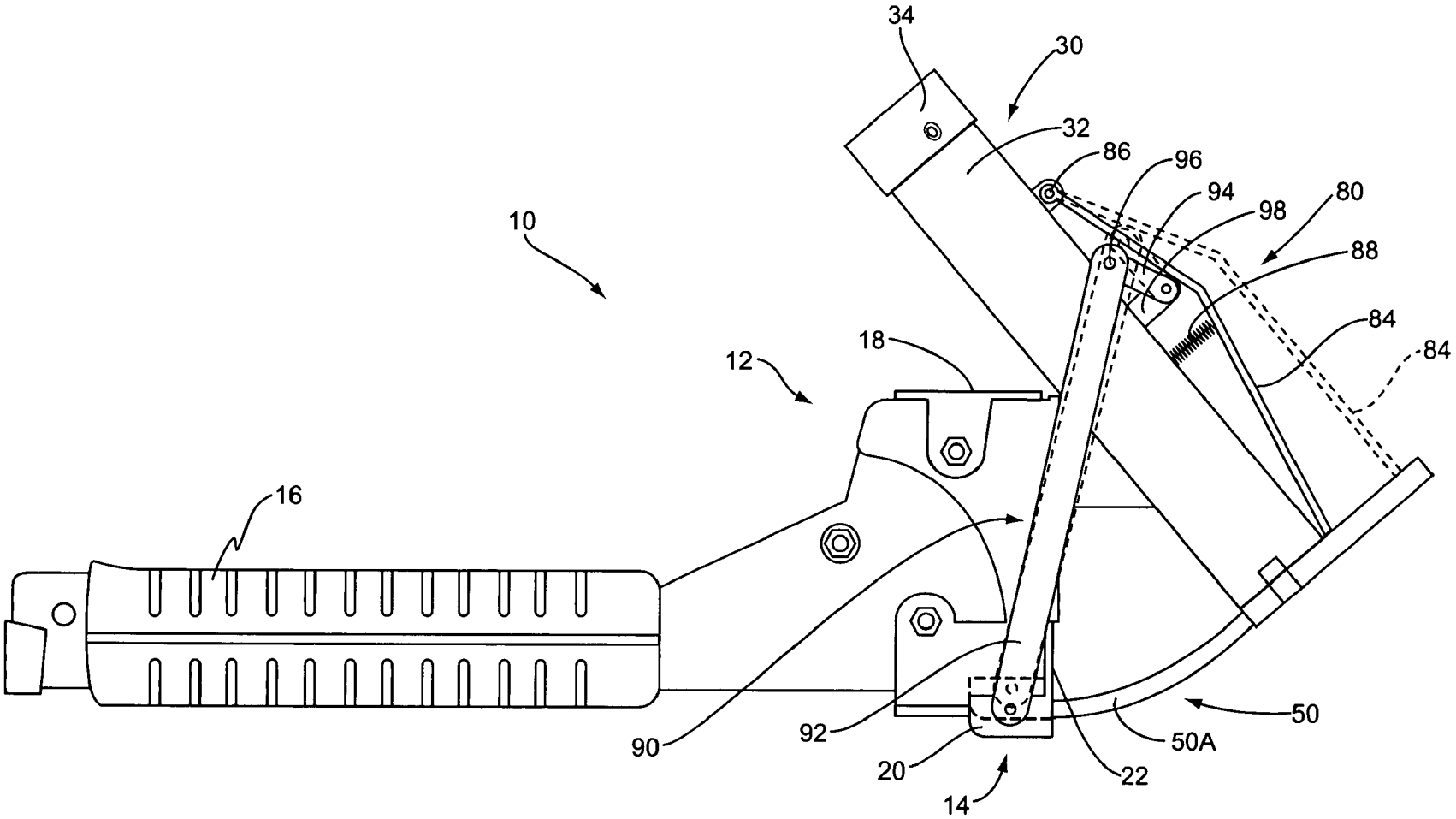
FIG. 2 is a side elevational view of the combination staple gun and cap feeding device.

In any event, reviewing the basic structure of the staple gun itself, the main body 12 includes an elongated handle 16. Although not shown, a staple holding magazine would be provided internally within the main body 12 and which would function to hold and supply staples to the staple gun. Extending from the handle 16 is a head 18. Movable member or striker 14 is disposed about the nose or lower front portion of the head 18. Movable member 14 includes a pair of side members 20 and a center member 22. As will be appreciated from subsequent portions of this disclosure, the side members 20 during a stapling operation typically engage an underlying surface S. Head 18 is pressed down towards the underlying surface S causing the movable member 14, including the side and center members 20 and 22, to move with respect to the head 18. Note that center member 22 during the course of the stapling operation moves upwardly, as viewed in FIG. 1, into the housing that forms a part of the head 18. In conventional fashion, the upward movement of the movable member 14 initiates a stapling action. That is, the staple gun and particularly the main body 12 functions to engage and drive a staple ST downwardly between the side members 20. The area underneath the head 18 and in the vicinity of the side members 20 is referred to as a staple ejection area 24.

Mounted to the staple gun is a cap feeding device indicated generally by the numeral 30. As will be explained below, cap feeding device 30 functions to hold and dispense caps 28. That is, each time the staple gun is actuated to cause a staple ST to be driven from the staple gun into an underlying surface S, the cap feeding device will function to dispense and position a single cap 28 into the path of the staple ST such that as a staple moves downwardly from the staple gun the staple will engage and remove the cap from the cap feeding device and in the process the staple ST will be forced through the cap 28 causing the cap to be secured to the underlying surface S by the staple ST. See FIG. 7D.

Viewing the cap feeding device 30 in more detail, the same comprises a cylindrical container 32 that includes a cylindrical wall structure and a top 34. As seen in FIGS. 3–6, container 32 includes a series of caps 28 stacked one over the other. Cap feeding device 30 also includes a spring 36 disposed on the top of the container and extending between the top 34 and the uppermost cap 28 in the stack. Effectively the spring 36 biases the stack of caps downwardly towards an open bottom formed in the container.

Extending between the open bottom of the container 32 and the staple ejection area 24 is a guide or track indicated generally by the numeral 50. Track 50 functions to guide or channel one cap 38 at a time from the bottom of the container 32 to the staple ejection area 24 where a staple can be shot or directed through the underlying cap 38. Various types of guides can be provided but in the embodiment illustrated herein, guide 50 comprises a track structure that includes a pair of C-shaped rails or tracks 50A and 50B. It is noted that the container 32 is disposed at an incline with respect to a horizontal line that runs parallel with the surface S as illustrated in FIGS. 3–6. Consequently, the guide or track 50 in this embodiment extends in a generally curved fashion from the open bottom of the container 32 to the staple ejection area 24. As will be appreciated from studying the drawings and the present disclosure, the segment of the guide or track 50 that extends between the container 32 and the staple ejection area 24 serves to hold and guide individual caps 38 towards the staple gun and the particular staple ejection area 24. However, as viewed in FIGS. 3–6, the track or guide 50 extends a short distance on the other side of container 32. This portion of the track acts to accommodate the cap feeder that will be described subsequently herein. Note in the drawings the relationship between the bottom portion of the container 32 and the guided track 50. Essentially the lower portion of the container 32 is aligned with the guide 50 such that the lower most cap of the stack contained within the container 32 is aligned with the C-shaped rails 50A and 50B during the cap dispensing operation.

For the most part, the guide or track 50 extending between the container 32 and the staple ejection area 24 comprises full C-shaped rails 50A and 50B. However, about the left most end portion of the guide 50, as viewed in FIGS. 3–6, the design of the guide 50 may be slightly altered to form a seat for the caps 38 that will permit the individual caps to be easily discharged from the track 50. Therefore, as viewed in FIGS. 7A–7D the guide or track 50 in the staple ejection area assumes a slightly different configuration. Here the lower portions of the C-shaped rail are shortened and tapered to form a tapered edge 50C. Further as illustrated here, the cap 38 also includes a tapered circumference. The combination of the tapered circumference of the cap 38 and the tapered edges 50C along with the flexibility of the cap allows the staple ST when driven downwardly into engagement with the cap to cause the same to flex and to be forced from the confines of the track or guide 50, again as illustrated in FIGS. 7A–7D.

Figure 3:
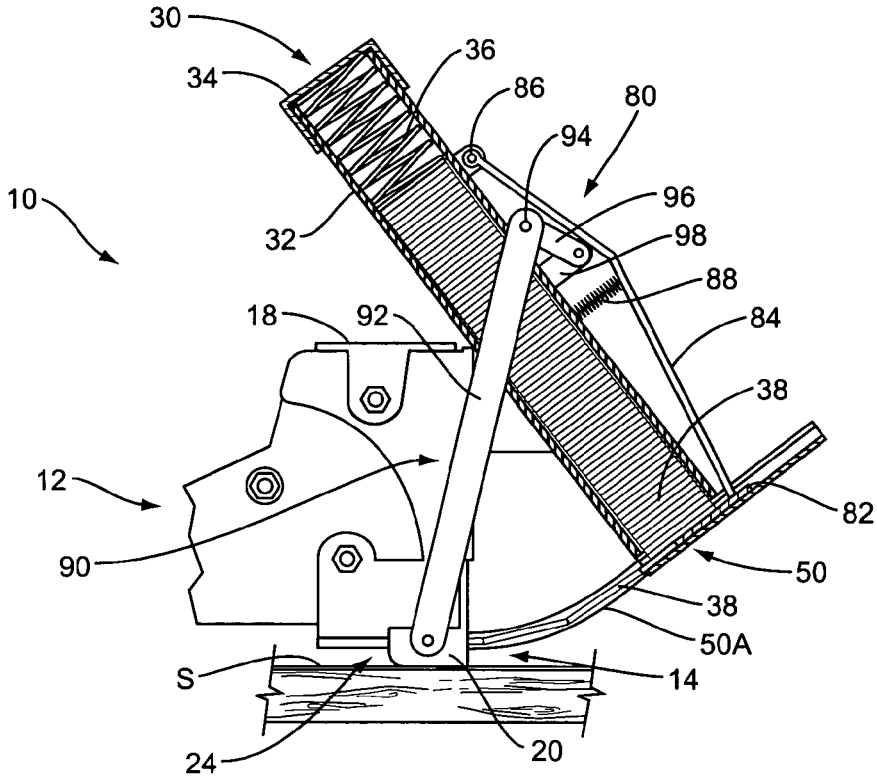
FIGS. 3–6 are a sequence of fragmentary sectional views of the combination staple gun and cap feeding device illustrating how the cap feeding device is actuated and driven in response to the staple gun directing a staple into an underlying surface.
Figure 4:
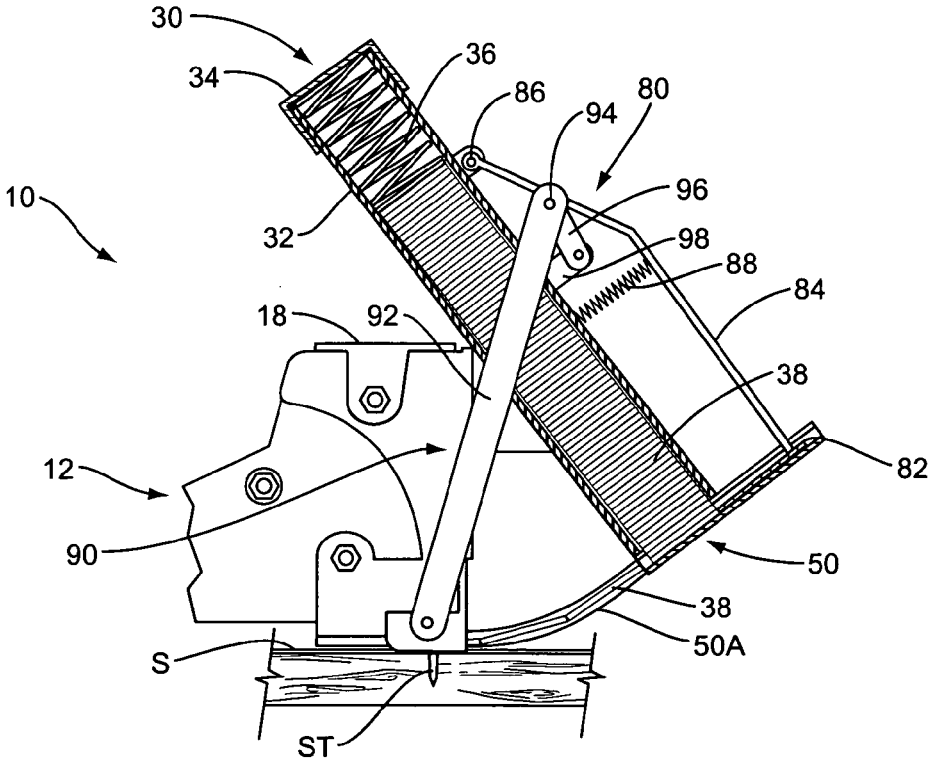
Figure 5:
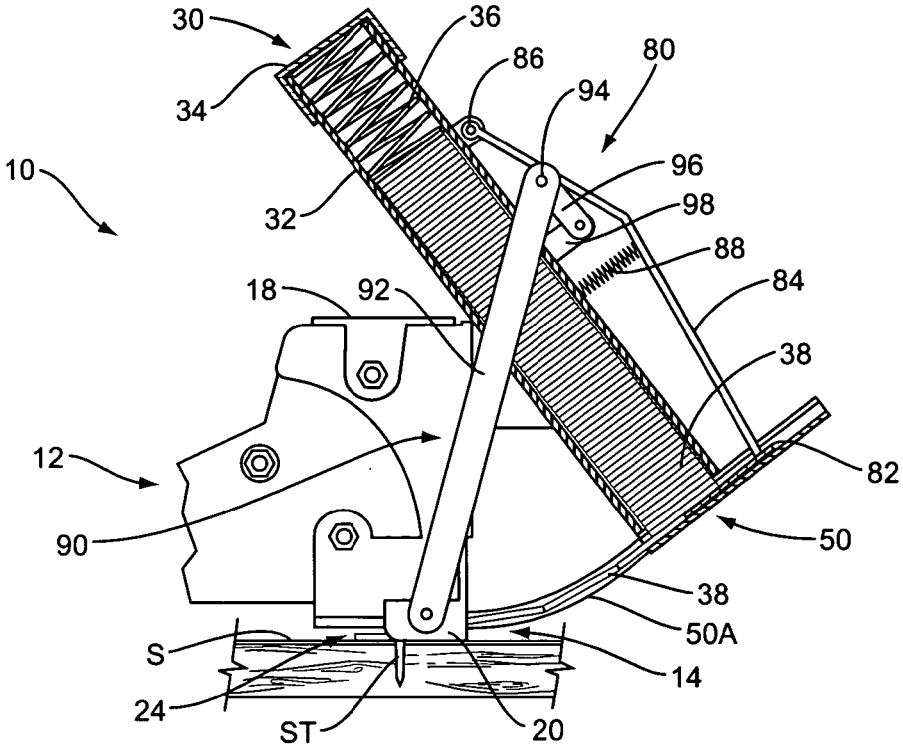
Figure 6:
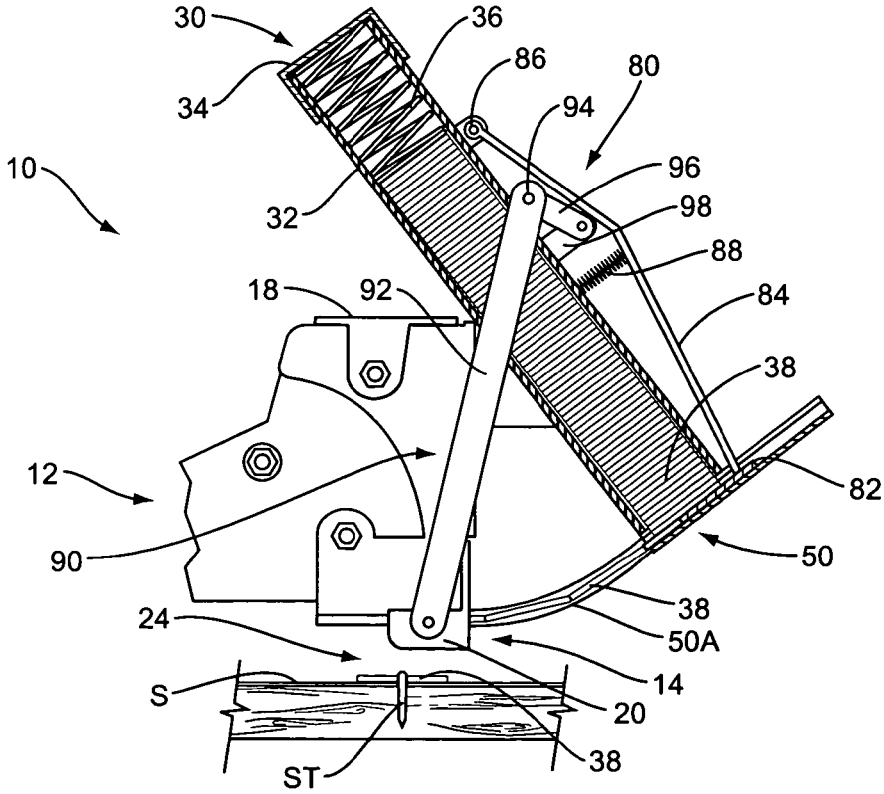

In order to feed the caps 38 from the container 32 into the guide 50, there is provided a cap feeding mechanism indicated generally by the numeral 80. Cap feeder mechanism 80 comprises a cap feeder for engaging the lower most cap 38 in the container 32 and urging the cap from the container into the guide 50. The cap feeder includes a cap engager or plate 82. Note that the cap engager or plate 82 is confined within the track 50 and as illustrated in FIGS. 3 and 4 moves between a first and second position. In the first position, as shown in FIG. 3, the cap engager 82 lies underneath the stack of caps 38 held within the container 32. In a second position, as illustrated in FIG. 4, the cap engager or plate 82 is still confined within the track 50 but is spaced to the right of the bottom of container 32. Connected to the cap engager 82 and extending upwardly therefrom is an arm 84. Arm 84 is connected to a pivot connection 86 that is secured to the exterior of container 32. A spring 88 is secured between the arm 84 and the sidewall of the container 32. Spring 82 biases the arm 84 towards the container and in the process biases the cap engager plate 82 towards the first position shown in FIG. 3. It will follow that by moving the arm 84 back and forth that the cap engager 82 will be moved back and forth between the positions shown in FIGS. 3 and 4 and in the process will push one cap 38 at a time from the container 32 into the track 50 leading from the container 32 to the staple ejection area 24.

The cap feeding device 30 also includes or has associated therewith an actuating mechanism, indicated generally by the numeral 90, for driving the cap feeding mechanism 80. Actuating mechanism 90 includes a pair of links 92. Each link 92 is pivotally connected about its lower end to a side member 20 of the staple gun. The upper end of the links 92 are interconnected by a cross pin 94. As seen in FIGS. 3–6, cross pin 94 extends between the wall of the container 32 and the arm 84 of the cap feeding mechanism. To station and position the cross pin 94, there is provided a pair of connecting links 96 which extend from the upper end portions of the links 92 to a pair of supports 94 that project outwardly from the wall of the container 32. Thus, it is appreciated that as the links 92 are driven up and down as viewed in FIGS. 3–6, that the cross pin 94 will engage the arm 84 and cause the arm and its associated cap feeder or plate 82 to move.

Figure 7A:
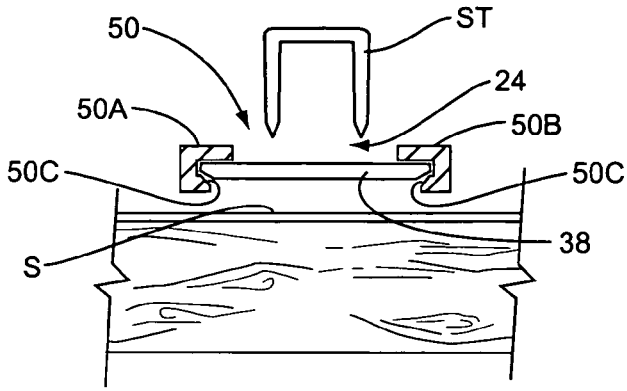
FIGS. 7A–7D are schematic illustrations showing how a staple ejected from the staple gun is directed into engagement with a cap and how the engagement of the staple with the cap causes the cap to be dislodged from a guide or track that forms a part of the cap feeding device.
Figure 7B:
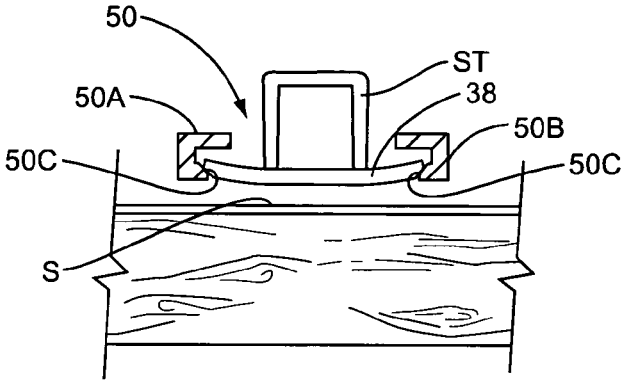
Figure 7C:
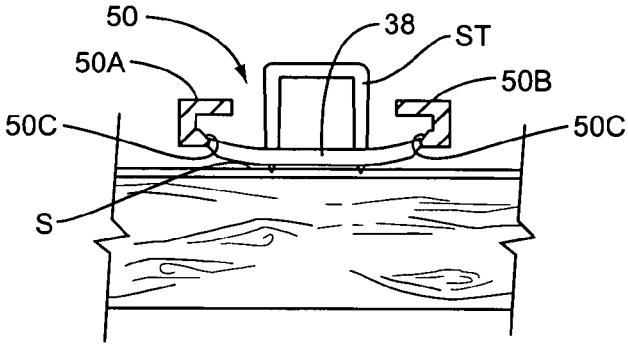
Figure 7D:
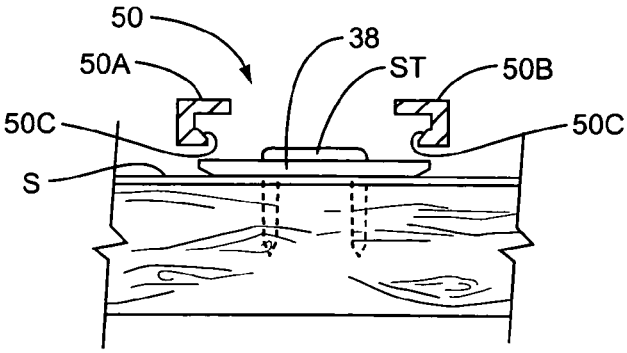

The operation of the combination staple gun and cap feeding device 10 of the present invention is illustrated in FIGS. 3–6 and FIGS. 7A–7D. The following description will describe one cycle of operation. In this regard the staple gun is placed down into engagement with a surface S. Note in FIG. 3 where the lower edges of the side members 20 engage the surface S. Thereafter the main body portion 12 of the staple gun is pressed downwardly towards the surface S. This results in relative movement between the head 18 of the staple gun and the side members 20. In particular, as the head 18 is pushed downwardly, the housing thereof tends to move downwardly around the center member 22 extending upwardly from the side members 20. During this process, in conventional and known fashion, a staple is forced or shot from the staple gun into the underlying surface S. Because a cap 38 would be positioned generally between the side members 20 and in the seat of the track 50, the ejected staple ST would engage and dislodge the cap 38 from the track 50 and in the process would secure the cap to the underlying surface S as illustrated in FIG. 7D.

As the main body 12 of the staple gun 10 is pushed downwardly to the position shown in FIG. 4, this causes the connecting links 92 to be moved upwardly with respect to the cap feeding device 30. As the links 92 move upwardly, the cross pin 94 extending between the upper portion of the links 92 will engage the arm 84 of the cap feeding mechanism 80. This will cause the cap engager or plate 82 to be moved from the first position underlying the caps 38 (FIG. 3) to the position shown in FIG. 4. This will permit the stack of caps 38 to drop down to where the lower most cap is held within or aligned with the guide or track 50. Once the lower most cap falls down and is aligned with or positioned in the track 50, it is appreciated that the cap is then appropriately aligned to be pushed to the left as viewed in FIGS. 3 and 4, towards the staple ejection area 24.

As the main body 12 is moved upwardly from the surface S to where the lower edges of the side members 20 clear the surface S, conventional biasing action of the staple gun causes the side members 20 to move away from the main body 12 of the staple gun thereby causing the links 92 to be withdrawn or moved generally downwardly. Thus the cross pin 94 is moved away from the arm 84. This permits the biasing action of the spring 88 to move the cap engager of plate 82 from the position shown in FIG. 4 to the position shown in FIG. 5. As the cap engager plate 82 moves from right to left as viewed in FIGS. 4 and 5, it is seen that the same will engage the lower most cap 38 within the container 32 and drive the lower most cap from right to left through the guide or track 50. As the main body 12 is further lifted from the surface S, the cap engager 82 is returned to its initial first position shown in FIGS. 3 and 6. Thus, in this cycle, a cap 38 has been discharged from the seat of the track 50 and another cap has been advanced down the track 50 to the seat area of the track, as illustrated in FIGS. 7A–7D where that cap is now appropriately aligned to be engaged and discharged by the next succeeding staple ST directed from the staple gun.

As described briefly above, the end portion of the guide 50 in the vicinity of the staple gun includes tapered edges 50C that in combination with the tapered circumference of the respective caps 38 permit the caps to be easily dislodged from the track 50 and secured to the surface S by the staple ST. Note in FIGS. 7A and 7B where the staple ST engages the cap 38 causing the same to be slightly deflected. As the staple ST is driven downwardly, as in FIG. 7C, it is seen that the flexing of the cap 38 results in the same being dislodged from the seat area of the track 50. Finally, as shown in FIG. 7D, the cap 38 is completely dislodged or discharged from the guide 50 and the staple ST has been directed downwardly through the cap into and through the underlying surface S.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A method of feeding caps from a cap feeder device to a manual staple gun wherein the cap feeder device is attached to or forms a part of the manual staple gun, comprising: manually actuating the staple gun by impacting a movable portion of the staple gun against a work surface and causing the movable portion of the manual staple gun to move with respect to another portion of the staple gun and resulting in the staple gun ejecting a staple; and driving the cap feeder device in response to the movable portion of the staple gun impacting the work surface and a staple being ejected from the staple gun, wherein the staple gun includes a main body and a striker movable with respect to the main body, and wherein the method entails hitting the striker against the surface and causing a staple to be ejected from the staple gun and driving the cap feeding device in response to the striker engaging the surface.

2. A method of feeding caps from a cap feeding device to a manually actuated staple gun wherein the cap feeding device is attached to or forms a part of the manually actuated staple gun having a movable striker that moves with respect to a main body portion of the staple gun, comprising:

a. impacting the striker of the manual staple gun against a work surface and moving the striker with respect to the main body portion of the staple gun and ejecting a stable from the staple gun;

b. driving a cap feeder associated with the cap feeding device in response to the manual actuation of the staple gun and the impacting of the striker against the work surface and the election of a staple from the staple gun; and c. wherein the step of driving the cap feeder includes moving a linkage that is interconnected between the striker and the cap feeding device and wherein the movement of the linkage is initiated by the impacting the striker of the staple gun against the work surface and causing one portion of the striker of the staple gun to move with respect to the main body of the staple gun.

3. The method of claim 2 including moving the cap feeder back and forth between first and second positions, and including biasing the cap feeder towards the first position and moving the cap feeder from the first position to the second position by impacting the staple gun against the surface and causing the linkage between the staple gun and the cap feeding device to be actuated.

4. The method of claim 2 wherein the cap feeder assumes a first position underneath a stack of caps contained within a container and is movable therefrom to a second position that permits a lowermost cap to move into alignment with a guide, and wherein the cap feeder is operative to move back to the first position underneath the stack of caps in the container, but wherein during the process the cap feeder is operative to engage the lowermost cap and advance the cap towards the staple gun.

5. The method of claim 2 wherein the staple gun includes a main body and a striker movable with respect to the main body and operative to cause one staple at a time to be ejected from the staple gun, and wherein the method includes striking the striker against the surface causing a staple to be ejected from the staple gun and wherein striking the striker against the surface drives the cap feeder.

6. The method of claim 2 wherein the staple gun includes a main body and a striker movable with respect to the main body and wherein the method includes actuating the staple gun by hitting the striker against a surface and causing a staple to be expelled from the staple gun and driving a linkage interconnected between the striker and the cap feeding device.

7. A manually actuated staple gun with a cap feeding device comprising:

a. a manually actuated staple gun for ejecting one staple at a time in response to the staple gun being impacted against a work surface;

b. a cap feeding device attached to the staple gun for dispensing one cap at a time into the path of a staple being ejected from the staple gun, the cap feeding device comprising:

i. a cap container for containing a stack of caps;

ii. a shuttle mechanism disposed adjacent the cap container and including a feeder that moves back and forth between a first and second position and wherein the feeder is operative to engage and move one cap at a time from the stack of caps contained in the cap container;

iii. a guide extending between the feeding device and the staple gun for directing caps from the cap feeding device to a position adjacent the staple gun such that staples being ejected from the staple gun can be directed through the caps;

iv. a movable mechanical linkage connected between the staple gun and the cap feeding device for causing one cap at a time to be positioned in the path of a staple being ejected by the staple gun; and v. the mechanical linkage being movable in response to the staple gun being manually actuated by impacting the staple gun against the work surface and causing a staple to be expelled therefrom and operative to actuate the shuttle mechanism and drive the feeder.

8. The manually actuated staple gun of claim 7 wherein the staple gun includes at least two portions wherein one portion of the staple gun moves with respect to the other portion, and wherein the cap feeding device is fixed with respect to one portion of the staple gun and the movable mechanical linkage is connected to the other portion.

9. The manually actuated staple gun of claim 8 wherein the movable mechanical linkage is arranged with respect to the manual staple gun and the cap feeding device such that as one portion of the manual staple gun moves with respect to the other, the mechanical linkage drives the shuttle mechanism and causes the feeder thereof to move between a first and second position.

10. The manually actuated staple gun of claim 9 wherein in the first position the feeder assumes a position underneath the stack of caps in the container, and wherein in the second position the feeder assumes a position spaced away from the first position which allows a lower cap of the stack of caps in the container to move into the guide.

11. The manually actuated staple gun of claim 10 wherein the shuttle mechanism includes a spring for biasing the feeder towards the first position.

12. The manually actuated staple gun of claim 11 wherein the feeder includes a cap engager and an arm extending from the cap engager and which is pivotally mounted on the cap feeding device.

13. The manually actuated staple gun of claim 12 wherein the spring is attached to the arm of the feeder and biases the cap engager to the first position that underlies the stack of caps in the container, and wherein the mechanical linkage is operative to engage and move the arm against the bias of the spring such that the cap engager is moved to the second position.

14. The manually actuated staple gun of claim 13 wherein the mechanical linkage includes a pair of spaced apart links that extend from the manual staple gun to a position where the mechanical linkage engages the arm of the feeder.

15. The manually actuated staple gun of claim 14 wherein the movable portion of the manual staple gun includes a movable member and wherein the other portion of the manual staple gun includes a main body portion and wherein when the manual staple gun is actuated the movable member engages a surface and moves with respect to the main body portion, and wherein the mechanical linkage for actuating the feeder is connected to the movable member.

16. The manually actuated staple gun of claim 7 wherein the container of the cap-feeding device is disposed at an incline and wherein the guide includes a curved track that extends from the bottom of the container to a staple ejection area of the staple gun.

17. The manually actuated staple gun of claim 7 wherein there is a staple ejection area associated with the staple gun and wherein the guide extends into the staple ejection area and includes a seat for holding individual caps in the staple ejection area, and wherein the seat is configured such that the force of a staple ejected through the underlying cap within the seat is sufficient to discharge the cap from the seat.

18. The manually actuated staple gun of claim 17 wherein the seat of the guide includes a tapered edge that facilitates the discharge of a cap from the seat.

19. The manually actuated staple gun of claim 7 wherein the staple gun includes a main body and a movable striker, and wherein the mechanical linkage connects the striker and the cap feeding device, and wherein the staple gun is manually actuated by hitting the striker against a surface which causes the mechanical linkage to be actuated and which in turn actuates the cap feeding device.

20. The manually actuated staple gun of claim 19 wherein the striker moves up and down with respect to the main body and wherein the striker is operative to drive the mechanical linkage as the striker moves up and down.

21. A combination manually actuated staple gun and cap feeding device comprising:

a. a manually actuated staple gun having a main body and a striker movable with respect to the main body in response to impacting the striker against a surface and operative to elect a staple from the staple gun in response to impacting the striker against the surface;

b. a cap feeder device mounted on the staple gun and including:

i. a container for holding a stack of caps;

ii. a guide extending between the container and a staple ejection area of the staple gun for directing caps from the container to the staple ejection area where a staple from the staple gun may be directed through an underlying cap so as to secure the cap to the surface;

iii. a feeder associated with the cap feeding device for transferring one cap at a time from the container to the guide;

iv. the feeder assuming a first position underneath the stack of caps and movable therefrom to a second position spaced from the first position such that the lower most cap of the stack can drop into a position where the lower most cap can be advanced through the guide to the staple ejection area; and v. means for moving the cap feeder back and forth between the first and second positions, said means including at least one spring for biasing the cap feeder towards one of the two positions and a linkage interconnected between the movable striker of the manually actuated staple gun and the cap feeder for driving the cap feeder towards the second position in response to the striker of the staple gun being impacted against the surface and staple being ejected from the staple gun.

22. The combination staple gun and cap feeding device of claim 21 wherein the container is disposed at an angle with respect to the main body of the staple gun.

23. The combination staple gun and cap feeder of claim 22 wherein the guide is non-linear.

24. The combination staple gun and cap feeding device of claim 21 wherein the cap feeder includes a cap engager that is slidable back and forth and an arm connected to the cap engager and pivotally mounted on the cap feeding device.

25. The staple gun and cap feeding device of claim 24 wherein the linkage extending between the striker and the cap feeding device engages the arm of the cap feeder and moves the arm in response to the staple gun being manually actuated and impacted against a surface, and wherein there is provided a spring that is connected to the arm of the cap feeder and biases the cap feeder towards the first position.

* * * * *

UNITED STATES PATENT AND TRADEMARK OFFICE

CERTIFICATE OF CORRECTION

PATENT NO. : 6,966,389 B1
APPLICATION NO. : 10/721618
DATED : November 22, 2005
INVENTOR(S) : Gregory Scott Riggs It is certified that error appears in the above-identified patent and that said Letters Patent is hereby corrected as shown below:

On the title page:
Item (73) Assignee: (no assignee) should be deleted

Signed and Sealed this

Twenty-second Day of May, 2007

JON W. DUDAS
*Director of the United States Patent and Trademark Office*